US007996931B2

(12) United States Patent
Plette

(10) Patent No.: US 7,996,931 B2
(45) Date of Patent: Aug. 16, 2011

(54) POOL DRAIN SAFETY DEVICES AND RELATED METHODS

(76) Inventor: Allison Sage Plette, Irvine, CA (US)

( * ) Notice: Subject to any disclaimer, the term of this patent is extended or adjusted under 35 U.S.C. 154(b) by 1208 days.

(21) Appl. No.: 11/470,816

(22) Filed: Sep. 7, 2006

(65) Prior Publication Data

US 2007/0107119 A1 May 17, 2007

Related U.S. Application Data

(60) Provisional application No. 60/737,608, filed on Nov. 17, 2005.

(51) Int. Cl.
*E04H 4/00* (2006.01)

(52) U.S. Cl. ..... 4/507; 4/504; 241/46.01; 415/121.1

(58) Field of Classification Search ..... 4/504, 507; 210/167.16, 167.13, 167.19; 415/121.1; 241/46.017, 46.06

See application file for complete search history.

(56) References Cited

U.S. PATENT DOCUMENTS

| | | | | |
|---|---|---|---|---|
| 4,868,984 | A * | 9/1989 | Elsherbini | 30/133 |
| 4,902,412 | A * | 2/1990 | Surber et al. | 210/167.13 |
| 5,031,320 | A | 7/1991 | Persyn | |
| 5,271,571 | A * | 12/1993 | Maynard, Jr. | 241/46.013 |
| 6,030,180 | A * | 2/2000 | Clarey et al. | 417/18 |
| 6,088,842 | A | 7/2000 | Barnett | |
| 6,751,814 | B2 | 6/2004 | Mattson, Jr. et al. | |
| 6,810,537 | B1 | 11/2004 | Barnes et al. | |
| 2004/0093666 | A1 | 5/2004 | Zars | |

* cited by examiner

*Primary Examiner* — Gregory Huson
*Assistant Examiner* — Lauren Heitzer
(74) *Attorney, Agent, or Firm* — Greenberg Traurig LLP; Franklin D. Ubell

(57) ABSTRACT

The novel enhanced pool safety device of the present disclosure increases safety around pools and prevents unnecessary drowning. The apparatus is disposed in a pool drain system and had been at least one blade connected to an axle and moved by the suction force provided by the filter system. As water moves from a pool to an intake duct via a drain, the combination of moving water and vacuum force turns blades, which cut foreign materials, such as hair, that comes through the drain grating. The cutting of these materials prevents loss of life that may arise as humans and other objects become entangled in pool drains.

10 Claims, 4 Drawing Sheets

POOL DRAIN SAFETY DEVICES AND RELATED METHODS

RELATED APPLICATIONS

This application claims the Paris Convention priority of U.S. Provisional Application No. 60/737,608 entitled "Novel Enhanced Pool Drain Safety Method and Device," filed Nov. 17, 2005, the contents of which are hereby incorporated by reference in their entirety.

BACKGROUND

The present disclosure relates to safety devices for pools. In particular, the present disclosure relates to a pool drain safety device and related methods. Several attempts to prevent hair and clothing entanglement in drains have been attempted. These include providing drain systems with sharp edges on which the swimmer may sever tangled hair. Other attempts include grating devices that do not allow hair and clothing to enter the drain. However, such highly exclusive filtration gratings significantly restrict the flow of water into the drain or require substantial surface area, reducing the efficiency of the pool circulation system. Thus, there has been a longstanding need for a system that does not restrict the flow of water into the drain and that cuts entangled objects without requiring the swimmer's intervention. However, none of these devices address or overcome those issues ameliorated by the present invention.

The following references are relevant to attempts to address the problem: U.S. Pat. Nos. 4,868,984; 5,031,320; 6,088,842; 6,751,814; and 6,810,537, as well as published Patent Application US 2004/0093666, each of which is incorporated by reference as if fully set forth herein.

SUMMARY

The novel enhanced pool drain safety device of the present disclosure increases safety around pools and prevents unnecessary drowning. The apparatus is disposed in a pool drain system and has at least one blade connected to an axle and moved by the suction force provided by the filter system. As water moves from a pool to an intake duct via a drain, the combination of moving water and vacuum force turns blades, which cut foreign materials, such as hair, that comes through the drain grating.

The present disclosure relates to a device comprising at least one movable blade disposed in a pool drain, wherein the force of water causes the blade to move.

Similarly disclosed is a method for cutting foreign objects coming into a pool drain system comprising providing at least one moveable blade disposed in a drain system, wherein the at least one moveable blade cuts foreign objects entering the drain system.

Finally, a business method of increasing safety in water recreation environments is disclosed comprising providing at least one moveable blade disposed in a drain system, allowing the at least one moveable blade to cut at least one foreign object introduced by a human into the drain system that prevent the human from surfacing, wherein the cutting of the at least one foreign object allows the human to surface.

BRIEF DESCRIPTION OF THE DRAWINGS

The above-mentioned features and objects of the present disclosure will become more apparent with reference to the following description taken in conjunction with the accompanying drawings wherein like reference numerals denote like elements and in which.

DETAILED DESCRIPTION

Figure 1:
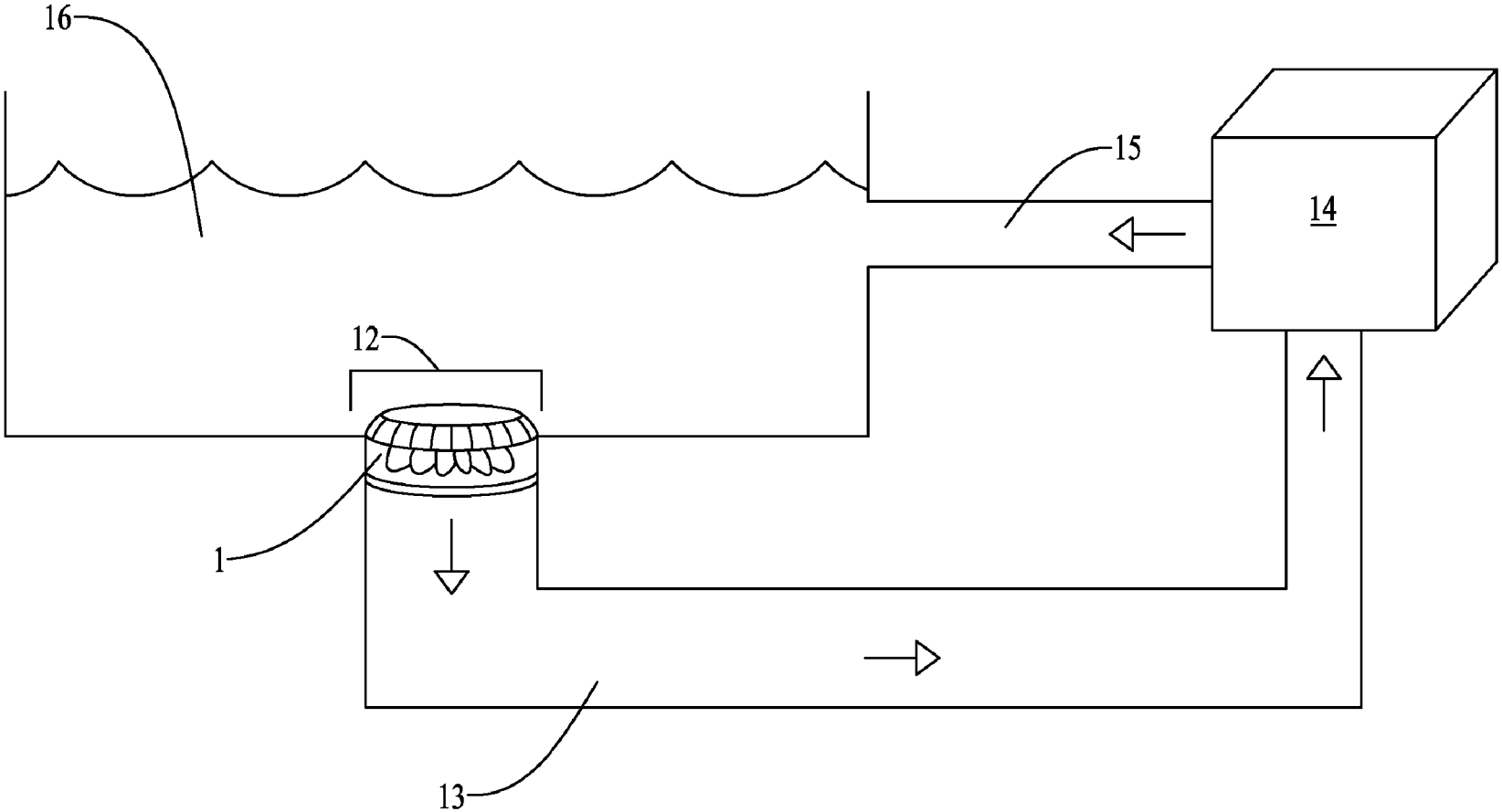
FIG. 1 is a schematic of an embodiment of the pool drain safety device system of the present disclosure.
Figure 2:
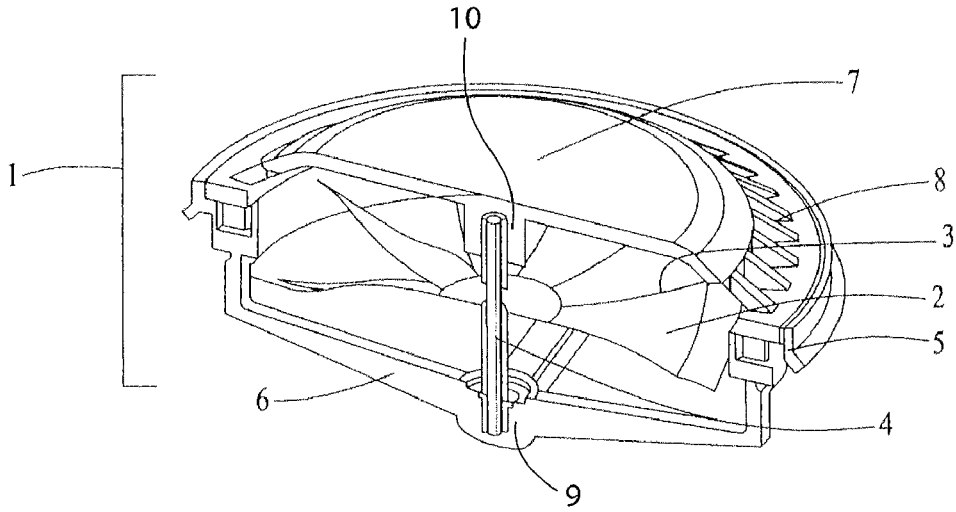
FIG. 2 is a perspective view of an embodiment of the pool drain safety device.
Figure 3:
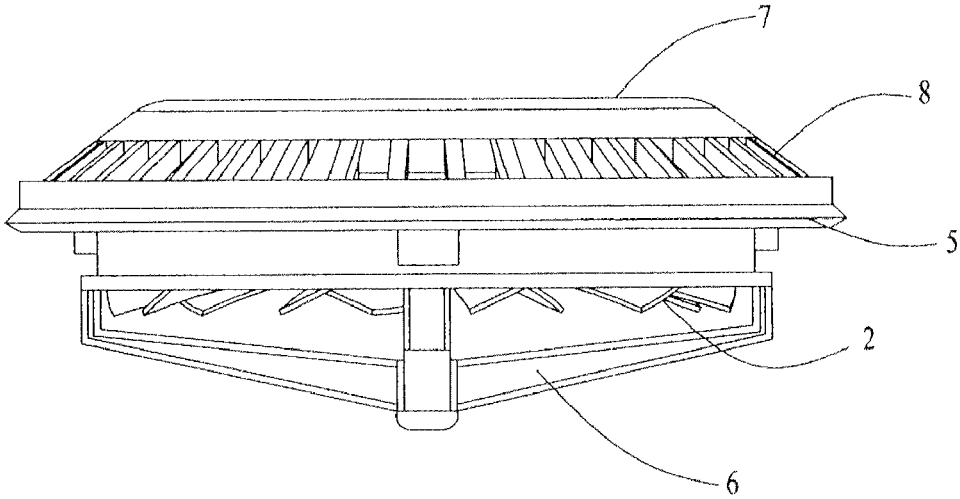
FIG. 3 is a side view of an embodiment of the pool drain safety device.
Figure 4:
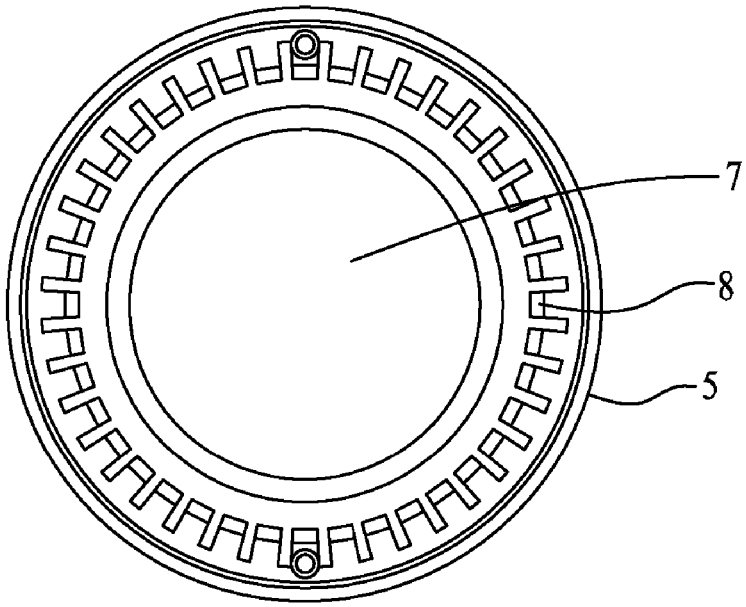
FIG. 4 is a top view of an embodiment of the pool drain safety device.
Figure 5:
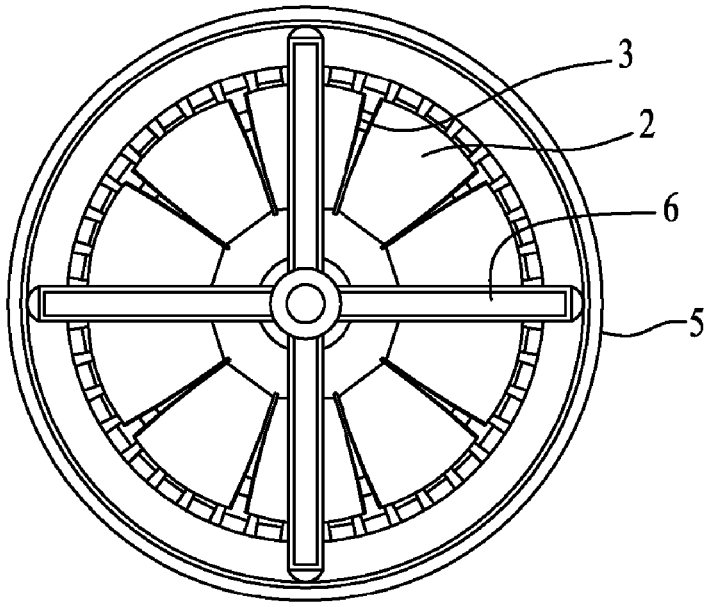
FIG. 5 is a bottom view of an embodiment of the pool drain safety device.

As used in the present disclosure, "pool" shall be understood to mean any artificial or natural body of water connected to a drain system where a swimmer's hair, clothing, or other objects that may be sucked into the drain system.

The present inventor has solved a long-standing need by providing a simple and mechanically elegant solution to the issue of pool drains becoming fouled with, for example, human hair and clothing.

The present disclosure is directed to an enhanced swimming pool drain safety method and device that satisfies these needs. The following is a summary of various aspects and advantages realizable according to various embodiments of the enhanced pool drain safety method and device according to the present disclosure. It is provided as an introduction to assist those skilled in the art to more rapidly assimilate the detailed discussion of the device that ensues and is not intended to limit the scope of the claims.

A feature of the present disclosure is to release swimmers who become entangled in pool drains by cutting the swimmer's hair, clothing, and other objects attached to a swimmer as they are sucked into the drain.

An additional object of the present disclosure is to release the entangled swimmer without requiring the swimmer to perform any act. This is accomplished by providing a cutting tool that provides the force to cut the entangled objects rather than providing a tool that requires the swimmer to provide the force.

Another object of the present disclosure is to perform the cutting without requiring a motor to operate the cutting tools. This is accomplished by driving the movement of the cutting tools by the flow of water. In an embodiment, rotating blades cut objects entering the drain. The blades may be angled such that the water flowing into the intake duct applies a force to the blades, which causes them to rotate. Alternatively, a turbine may be attached to the blades to cause them to rotate by using the flow of water over the turbine. Thus, the blades would not require a separate motor to operate.

Yet another feature of the present disclosure is to maintain flow rate efficiency of a circulation system while preventing larger objects, such as swimmer's appendages, from entering the drain. By providing a drain cover with a grating that allows only water and small objects to pass, this objective is accomplished. While pool drain covers are well known in the art, its combination with cutting tools to increase swimmer safety and improve filter efficiency comprises a novel system without compromising the function of the drain or the flow rate of the water moving through it.

The present disclosure relates to swimming pool drain safety methods and devices. According to an embodiment of the present disclosure, a pool drain safety device is disposed at the entrance of an intake duct such as a pool drain. While a pool circulation system operates, it draws water through the drain which creates a strong suction force at the entrance to the drain. A swimmer that approaches the drain too closely risks having hair or clothing sucked into the drain among other known maladies associated with pool drain suction, such as disembodiment. Hair and clothing may get tangled in the drain after being sucked into the drain, causing death by drowning or other injuries. The present devices are designed to cut hair and clothing as they come through the drain, preventing tangling or releasing the swimmer whose hair or clothing has been caught and tangled by the suction of the drain. The device also cuts other objects entering the drain into smaller pieces for more efficient filtration later in the pool circulation system. No limitations of the applicant's subject matter are intended by this illustrative example; similar devices may be applied to other intake ducts where suction force may pose a danger due to the potential for hair or clothing entanglement.

In the United States, drowning is the second leading cause of accidental death among children under 15 years of age. Every year, hundreds of children in this age group die as a result of accidental drowning and thousands more are injured. Entanglement, which occurs when a swimmer's hair or clothing is caught by an underwater drain, causes many of these deaths and injuries. At least about 41 percent of all entanglement incidents involve the victim's hair. The need to protect children from entanglement is particularly great because since 1990, 93 percent of hair entanglement deaths and injuries have been among children ages 15 and under.

Using the system disclosed herein may therefore reduce incidence of death and injury by pool drain entanglement. The safety benefits are accomplished without substantial restriction the flow rate efficiency of the circulation system by filtering objects that may otherwise tangle in the drain 12 (see for example FIG. 1). Further, the present disclosure does not require its own motor for operation, but rather may be driven by the flow of water. Further still, the present disclosure does not require that the entangled swimmer perform any act to operate the device.

As shown in FIG. 1, there is shown pool drain safety device 1 of the present disclosure used in conjunction with a pool water circulation system. Artisans are well aware of a plurality of conventional makers, systems, and types of such pool water circulation systems. During operation, the water from pool 16 is drawn through drain 12 and into intake duct 13 due to suction provided by pool pump and filter system or circulation system 14. Pool drain safety device 1 may be installed at or near drain 12. When circulation system 14 is engaged, water passes from pool 16 to intake duct 13. Blades 2 of pool drain safety device 1 rotate due to the flow of water against blades 2, which act similar to a turbine. Blades 2 may also be rotated with a dedicated turbine 11 (see FIG. 6). As a swimmer nears drain 12, hair or clothing that enters the drain are cut by blades 2, preventing them from tangling in drain 12 and holding the swimmer under water. No limitations on blade shape and configuration are intended by the demonstrative embodiments shown.

Turning now to an embodiment shown in FIG. 2-5, a pool drain safety device 1 is shown. Pool drain safety device 1 comprises a plurality of blades 2 connected to axle 4. The blades 2 extend radially outward from the axle 4, such that each imaginary line bisecting a blade 2 is substantially equidistant from the imaginary lines bisecting the adjacent blades 2.

Cover 7 connects to rim 5. Water is permitted to pass through cover 7. A plurality of grating holes 8 prevent large objects from entering circulation system 14. Nevertheless, smaller objects such as hair and clothing strings are often small enough to fit through grating holes 8. As used in the present disclosure, cover 7 should have grating holes 8 large enough to allow fluid and small objects to freely travel through, but small enough to prevent entrance of a swimmer's digit or appendage. The exact specifications of cover 7 and grating holes 8 are well known in the art in many variations. The present disclosure is suited and applicable to many, if not all, of the current cover 7 variations used.

Rim 5 is provided of such shape and size that it conforms to the shape and size of drain 12. Rim 5 connects to cover 7. A plurality of support arms 6 extend inward from rim 5 and converge at the center of the area defined by rim 5. Support arms provide support for axle 4 and blades 2. One end of axle 4 connects to lower cavity 9, which is disposed at the point of convergence of the support arms 6. The other end of axle 4 connects to upper cavity 10, which is disposed at the center of cover 7. Thus, axle 4 is disposed in and spans the imaginary line between lower cavity 9 and upper cavity 10. Each end of axle 4 connects to lower cavity 9 and upper cavity 10 such that axle 4 may rotate while rim 5, support arms 6, the cover 7 remain stationary relative to the movement of axle 4.

According to embodiments, the devices of the present disclosure are adapted to commercially available covers 7. According to these embodiments, rim 5 of pool drain safety device 1 is of such shape and size as to conform to the shapes and sizes commercially available covers 7. Rim 5 connects to the commercially available cover 7. According to embodiments, axle 4 connects solely to lower cavity 9 and does not require modification or adaptation of the commercially available covers 7. Thus, according to these embodiments, no upper cavity 10 is provided. Instead, the lower cavity-axle-blade unit operates stably without substantial articulation with the commercially available cover 7 apart from the connection to rim 5. According to similar embodiments, however, the inventors of the present disclosure expressly contemplate modification or adaptation of commercially available covers to successfully practice the teachings of the present disclosure. Moreover, the teachings of the present disclosure may be combined with preexisting anti-entanglement designed covers.

Because axle 4 may rotate rapidly, friction and excessive wear considerations must be taken into account. According to an embodiment, a pair of sealed bearings may be disposed in each of lower cavity 9 and upper cavity 10 to dissipate friction and extend the useful life of pool drain safety device 1. It is intended that such a system would require little to no maintenance over the life of the drain component.

According to similar embodiment, axle 4 may be designed where it does not rotate with blades 2. Rather, a blade sheath (not shown) to which blades 2 are connected, which extends a substantial length of axle 4 between lower cavity 9 and upper cavity 10, rotates about axle 4. Both axle 4 and axle sheath would be made of durable materials to provide a long functional life. To prevent friction between axle sheath and axle 4, fluid, a lubricant, lubricious surface, or a sealed bearing system may be disposed between axle sheath and axle, according to embodiments. The actual implementation of such modifications and variations would be understood and known to a person of skill in the art.

According to embodiments, blades 2 are disposed radially outward from axle 4, and one end of axle 4 is connected to upper cavity 10 of the cover 7. Blade 2 connects to the other end of axle 4. The entire blade-axle system requires no lower cavity 9 or support arms 6, but functions rather as a free unit without the need of lower support.

One or more blades 2 are connected to axle 4 an axle sheath. Blades 2 rotate, when circulation system 14 is activated, with enough force to sever hair, clothing, and other small objects passing through grating holes 8. Consequently, blades 2 must be strong enough to withstand cutting events, the chemical environment of pools, and extended service life. More particularly, blades 2 should be hard and sharp enough to cut hair, strings, and other objects. Similarly, blades 2 should be durable enough to withstand numerous cutting events over a long period of time. Cutting edges 3 therefore must remain sharp throughout this period. Naturally, blades 2 may be made from metals such as stainless steel; other strong, non-corrosive metals; plastics; or polymers. The choice of the particular blade material is understood and known to a person of ordinary skill in the art. The material used to make the blades 2 should not corrode, rust, or otherwise oxidize in fresh or salt water. Moreover, the blades 2 should not react or be affected by pool additives, such as chlorine, bromine, and other pool chemicals.

Cutting edge 3 of each blade 2 is oriented in the same direction as all other cutting edges 3 with respect to direction of rotation and cutting plane. The cutting plane is defined to be an imaginary cylinder, where the cylinder's radius is defined to be the greatest of the radii measured as the length of each blade 2 from the center point of axle 4 to the point on each blade 2 furthest from the center point of axle 4. The height of the imaginary cylinder is measured as the cylinder height defined by the distance measured from the point of blades 2 closest to cover 7 to the point of blades 2 furthest from the cover 7. The present disclosure contemplates at least one cutting plane. Cutting edges 3 defines the point where hair, clothing, and other objects are cut.

According to embodiments, cutting edges 3 of blades 2 are disposed to contact an inside surface of cover 7 during rotation of blades 2 about axle 4. As the blades 2 rotate, cutting edge 3 of blades 2 moves along inside surface similar to the operation of an electric razor. As hair, clothing, or other foreign objects pass through grating holes 8, they are sheared, such as by a scissoring effect, between the inner surface of cover 7 and cutting edge 3 before they are able to tangle and trap a swimmer or soon after a tangle is formed so that the swimmer may escape to the surface.

According to an embodiment, blades 2 are shaped and angled such that when water moves from pool 16 into the intake duct 13, the force of the flow of water over the blades 2 turns them in the same way that water turns a turbine. Cutting edges 3 of blades 2 are oriented to be the leading edge with respect to the rotation.

Some pools have drains 12 with larger surface areas designed to reduce the suction force per area unit. For these types of drain systems, angling blades 2 to induce rotation may fail to provide the requisite blade velocity to enable blades 2 to sever hair, clothing, and other objects passing through grating holes 8 and into drain 12. Consequently, turbine 11 must be introduced into the system to produce the requisite blade velocity to sever hair, clothing, and the other potential objects entering the circulation system. In these type systems, turbine 11 may be disposed in intake duct 13 pipes where the force of water aggregates to rotate blades 2 at sufficient speed to sever the hair, clothing, and other objects. Thus, it should be clear to artisans that turbine 11 and blades 2 need not be disposed in close proximity to each other.

Figure 6:
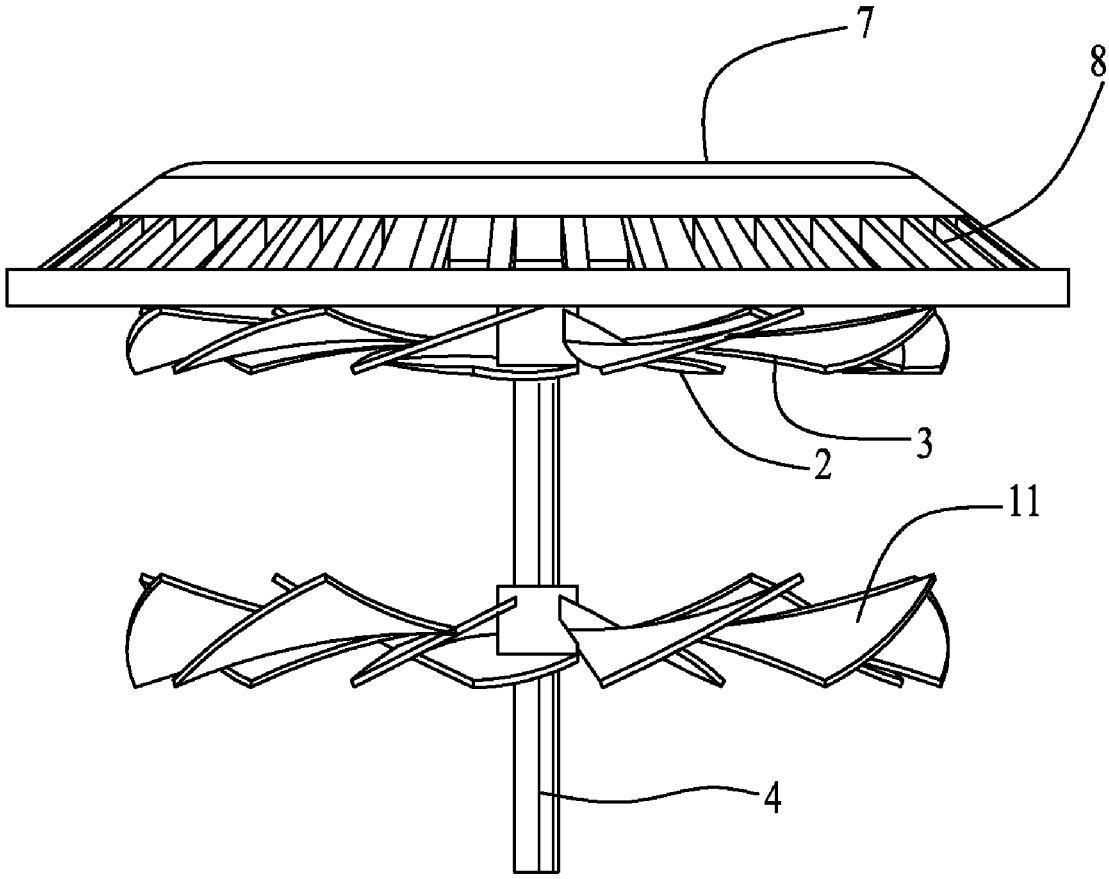
FIG. 6 is a perspective view of an embodiment of the pool drain safety device of the present disclosure.

According to an embodiment shown in FIG. 6, turbine 11 is connected to axle 4 which turns blades 2. The flowing water turns the turbine 11, which applies torque to axle 4. Axle 4 then applies a torque to the blades 2, which causes them to turn. Because blades 2 may rely on turbine 11 for rotation, blades 2 need not act as a turbine and provide rotation for themselves. Thus, the shape and angle of blades 2 is then irrelevant, except with regard to flow rate efficiency. Indeed, in the exemplary embodiment shown in FIG. 6, blades 2 are thin to prevent inefficiencies in the flow of water and to reduce potential cavitation effects.

In addition to hair and clothing of trapped swimmers, the system of the present disclosure also cuts foreign objects small enough to pass through the grating holes 8 prior to entering circulation system 14. Thus, the present disclosure also contemplates a device that reduces the size of matter passed into the pool pump and filter. Embodiments of this type have application to filters on ponds, aquariums, and other applications where human safety isn't always at issue, but where filters potentially suck in detritus and larger type materials through their intakes. Consequently, filtering efficiency improves by reducing the size of the filtered materials, which extends the life of filters and filtering materials, as well as prevent clogs of larger objects, such as algae and other organic matter, in the filter pipes.

Referring again to FIG. 1 and an embodiment of a method, pool drain safety device 1 automatically activates when circulation system 14 of pool 16 is activated. As water flows from pool 16 into intake duct 13, it passes through drain cover 7 through grating holes 8. The force of the water being sucked into intake duct 13 caused by the operation of the pump of circulation system 14 forces water to pass over blades 2 or turbine 11, effective rotation of blades 2. The rotation of blades 2 or turbine 11 causes blades 2 to rotate with sufficient speed to cut foreign objects, such as hair and clothing, that come through grating holes 8. Consequently, hair and clothing that would otherwise potentially trap a swimmer under water, are severed before they tangle and trap the swimmer or soon thereafter.

Moreover, according to an embodiment of a business method, the system of the present disclosure may be provided in pool systems to increase the safety of recreators. As disclosed above, the system may be disposed in a pool. When a swimmer's hair or clothing becomes tangled in the drain due to suction force, the blades of the system will cut the hair or clothing, allowing the swimmer to surface, providing a safer environment in which to recreate.

While the apparatuses and methods have been described in terms of what are presently considered to be the most practical and effective embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A pool drain safety device comprising:

a drain cover comprising a grating and having an inner surface;

at least one movable blade, the blade having a cutting edge sufficiently hard and sharp to cut a selected foreign object or objects, said foreign object or objects comprising one or more of hair and/or at least part of an item of clothing, the blade being rotatably mounted in a drain beneath said cover and spaced apart therefrom a distance selected to create a shearing effect between said cutting edge and said inner surface; and wherein the blade is shaped such that the force of water causes the blade to rotate and to perform a cutting action with respect to a said selected foreign object.

2. The device of claim 1, wherein the device results in more effective filtration of a pool.

3. The device of claim 1, wherein the at least one moveable blade is angled such that the fluid flowing into an fluid intake causes the at least one moveable blade to turn about an axis.

4. A method for cutting foreign objects coming into a drain system comprising:

providing at least one moveable blade having a cutting edge disposed in a drain system beneath a perforated drain cover and disposed apart from an inner surface of said cover a selected distance so as to create a shearing effect between said cutting edge and said inner surface; and employing the at least one moveable blade to cut foreign objects entering the drain system; and wherein the at least one moveable blade is shaped such that the force of the water causes the blade to rotate and to perform a cutting action with respect to a said foreign object, by the force of water flowing through the drain system.

5. The method of claim 4, further comprising the step of freeing a swimmer trapped by a foreign object caught in the drain system by cutting the foreign object and thereby releasing the swimmer.

6. The method of claim 5, wherein the foreign object comprises hair.

7. The method of claim 5, wherein the foreign object comprises at least a part of an item of clothing.

8. A method of increasing safety in water recreation environments comprising:

providing at least one moveable blade having a cutting edge disposed in a drain system beneath a perforated drain cover and disposed apart from an inner surface of the cover a selected distance so as to create a shearing effect between said cutting edge and said inner surface;

employing the at least one moveable blade to cut at least one foreign object introduced into the drain system which otherwise would prevent a human from surfacing;

thereby allowing the human to surface; and wherein the shape of the blade and the flow of water through the drain rotates the at least one moveable blade and causes the moveable blade to perform its cutting action with respect to said at least one foreign object.

9. The method of claim 8, wherein the foreign object is hair.

10. The method of claim 8, wherein the foreign object comprises at least a part of an item of clothing.

* * * * *